US007255584B2

(12) United States Patent
Takashita

(10) Patent No.: US 7,255,584 B2
(45) Date of Patent: Aug. 14, 2007

(54) ELECTRICAL CONNECTOR FOR A FLAT-TYPE CABLE

(75) Inventor: Yoshinori Takashita, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/528,626

(22) Filed: Sep. 28, 2006

(65) Prior Publication Data

US 2007/0077809 A1 Apr. 5, 2007

(30) Foreign Application Priority Data

Sep. 30, 2005 (JP) ..... 2005-286006

(51) Int. Cl.
*H01R 13/15* (2006.01)

(52) U.S. Cl. ..... 439/260; 439/495

(58) Field of Classification Search ..... 439/260, 439/492, 493, 494, 499
See application file for complete search history.

(56) References Cited

U.S. PATENT DOCUMENTS

| | | | | |
|---|---|---|---|---|
| 5,906,498 | A * | 5/1999 | Nagafuji | 439/260 |
| 6,726,497 | B2 * | 4/2004 | Nogawa et al. | 439/260 |
| 6,761,573 | B1 * | 7/2004 | Chiu | 439/260 |
| 6,855,002 | B2 * | 2/2005 | Chiu | 439/495 |
| 7,044,773 | B2 * | 5/2006 | Suzuki et al. | 439/495 |
| 7,083,454 | B2 * | 8/2006 | Suzuki | 439/260 |
| 7,094,093 | B2 * | 8/2006 | Nakano et al. | 439/495 |
| 7,137,838 | B2 * | 11/2006 | Koga | 439/260 |
| 7,140,896 | B2 * | 11/2006 | Takai et al. | 439/260 |
| 7,147,498 | B1 * | 12/2006 | Gillespie et al. | 439/260 |
| 7,172,446 | B1 * | 2/2007 | Hashimoto et al. | 439/260 |
| 2003/0087544 | A1 * | 5/2003 | Nogawa et al. | 439/260 |
| 2004/0023551 | A1 * | 2/2004 | Suzuki et al. | 439/495 |
| 2005/0136732 | A1 * | 6/2005 | Suzuki | 439/495 |
| 2006/0084311 | A1 * | 4/2006 | Suzuki et al. | 439/260 |
| 2006/0105622 | A1 * | 5/2006 | Nakano et al. | 439/495 |
| 2006/0110974 | A1 * | 5/2006 | Suzuki et al. | 439/495 |
| 2006/0205257 | A1 * | 9/2006 | Suzuki et al. | 439/260 |
| 2006/0270270 | A1 * | 11/2006 | Yokoyama | 439/495 |
| 2006/0286843 | A1 * | 12/2006 | Fukazawa | 439/260 |
| 2007/0032115 | A1 * | 2/2007 | Takashita | 439/260 |

(Continued)

FOREIGN PATENT DOCUMENTS

| | | |
|---|---|---|
| JP | 2005-78908 | 3/2005 |

*Primary Examiner*—Ross Gushi
(74) *Attorney, Agent, or Firm*—Takeuchi & Kubotera, LLP

(57) ABSTRACT

The latching metallic piece (12) has a lever-like arm (20) that extends in the direction of receiving the flat-type cable C. The lever-like arm (20) has a latching claw (20A) at one end, a fulcrum section (22) at the middle point, and an extending section at the other end. A pressuring member (14) has a restricting section that does not contact with the extending section (20B) of the latching metallic piece (12) at the open position, and that prevents the displacement of the extending section at the closed position. When the pressuring member is at the open position, the lever-like arm (20) is in the state that it can be freely displaced so as to allow insertion/removal of the flat-type cable. When the pressuring member is at the closed position, the displacement of the lever-like arm relative to the latching section in the direction that increases the latching of the latching claw (20A) is prevented, and the displacement of the lever-like arm in the direction that reduces the latching is prevented.

4 Claims, 3 Drawing Sheets

U.S. PATENT DOCUMENTS

2007/0049087 A1* 3/2007 Hashimoto et al. ..... 439/260
2007/0087605 A1* 4/2007 Suzuki et al. ..... 439/260
2007/0093122 A1* 4/2007 Kudo et al. ..... 439/495

* cited by examiner

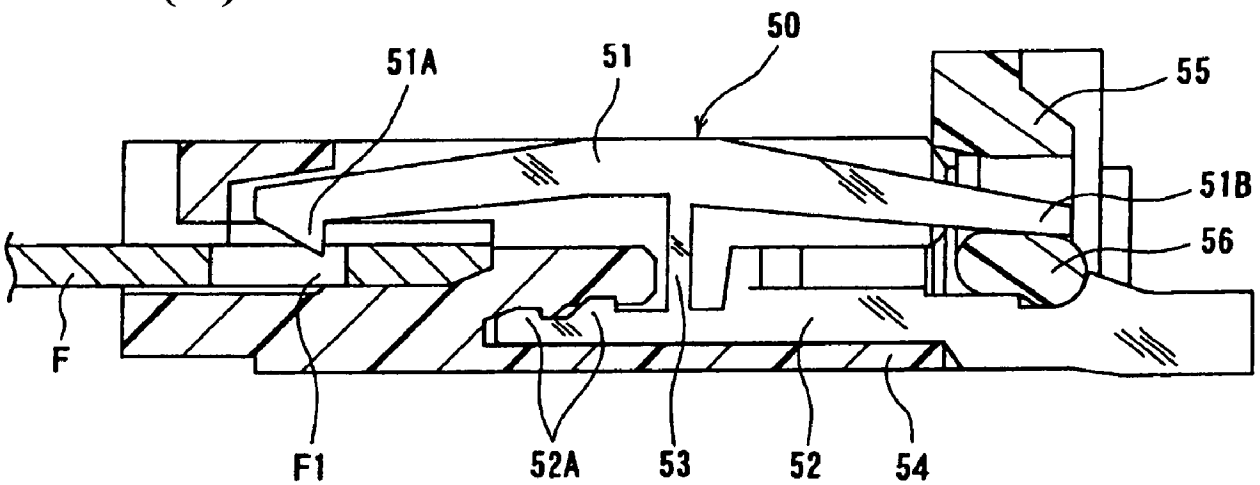
FIG. 3 (A) PRIOR ART
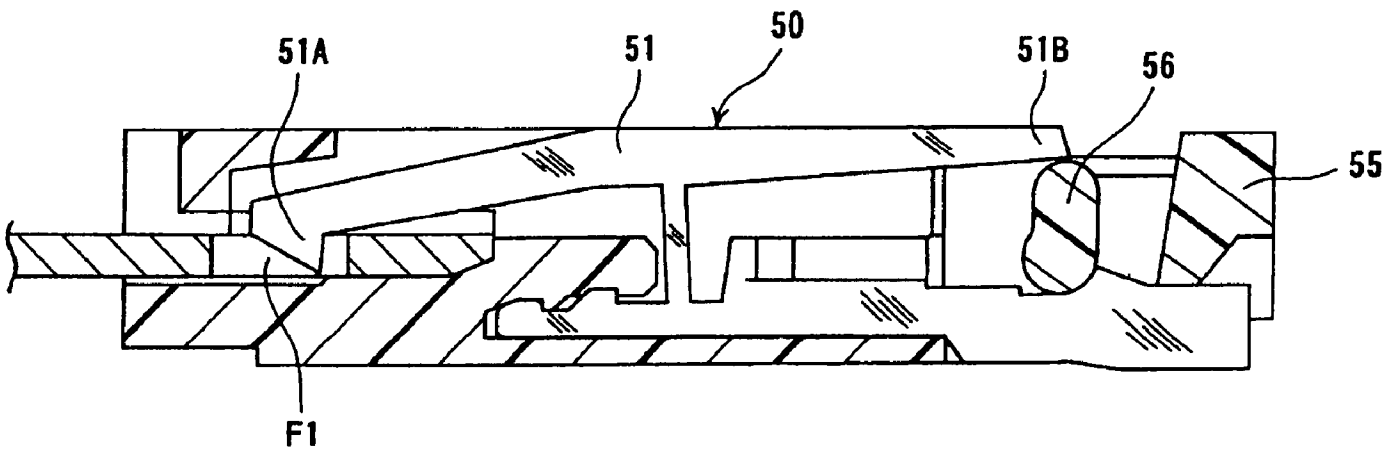
FIG. 3 (B) PRIOR ART

ELECTRICAL CONNECTOR FOR A FLAT-TYPE CABLE

BACKGROUND OF THE INVENTION

1. Field of the Invention

The present invention relates to an electrical connector for a flat-type cable.

2. Description of the Related Art

For an electrical connector for a flat-type cable, such as a flat cable and a flexible circuit board, for example, a connector disclosed in Patent Reference 1 is known. In the connector of Patent Reference 1, a plurality of terminals formed by punching a metal sheet is arranged such that the sheet surfaces are parallel to each other. A latching metallic piece 20 having similar shape to that of the terminals as shown in the accompanying drawing, FIG. 3(A), is provided at the both ends of the arrangement.

As shown in the figure, each latching metallic piece 50 has generally H-shape, and has an upper arm 51 and a lower arm 52, which are connected by a connecting section 53. The upper arm 51 has flexibility to displace upward/downward, while the connecting section 53 works as the fulcrum, and has a latching claw 51A at its front end, and a pressuring section 51B at its rear end. When the latching metallic pieces 50 are inserted from the rear side (right side in the figure) to corresponding slits of the housing 54, each lower arm 52 is securely held by the housing 54. To secure this holding, each lower arm has latching protrusions 52A.

A cam section 56 having an oval surface is formed at each pressuring member 55 and located between the rear ends of the upper arm 51 and the lower arm 52, and contacts with the inner edges of those arms. Each pressuring member 55 makes rotational movement between the open position illustrated in FIG. 3(A) and the closed position illustrated in FIG. 3(B), having the cam section 56 as the center of the rotation. In this connector, terminals which are not illustrated in the figures have generally similar shape as that of the latching metallic pieces. In addition, each pressuring member has a cam section, which is similar to the cam section 56, for the terminals.

When the pressuring member is at the open position as illustrated in FIG. 3(A), the cam section is horizontally long, but once the flat-type cable F is inserted from the left side, the cable contacts with the contact section which is at the left end of the terminal, and then moves to a specified inserting position, while lifting the contact section. When each pressuring member is rotated to the closed position as illustrated in FIG. 3(B), and the cam section is moved and turned to be vertically long, the cam section 56 displaces so as to lift the right end of the upper arm of each terminal. The cam section that corresponds to each terminal also similarly displaces. As a result, since the cable does not have a latching hole to receive the left end of the upper arm of each terminal, the left end of the upper arm works like a lever and is deformed downward so as to increase the contact pressure to the cable.

As shown in FIGS. 3(A) and 3(B), the flat-type cable F has latching holes F1 for the latching claws 51A to latch on, corresponding to the positions of the latching metallic pieces 50 that are provided at the both ends of the arrangement of the terminals. Similarly to the terminals, when the pressuring member 55 is at the open position as illustrated in FIG. 3(A), the cable can be easily inserted. Once it is inserted to a specified position, each latching claw 51A is latched onto the latching hole F1 of the cable F. Then, similarly to the terminals, once the pressuring member 55 is moved to the closed position of FIG. 3(B), the right end of each upper arm 51 is lifted by the cam section 56. Accordingly, the latching claw 51A displaces further downward, and the latching is increased. When the connector is in use, the right end of each upper arm 51 is lifted by the cam section.

[Patent Reference 1] Japan Unexamined Patent Application Publication 2005-078908

In the connector of Patent Reference 1, once the pressuring member is brought to the closed position, each latching claw is securely latched onto the latching hole, so that coming off of the cable is effectively prevented. However, the upper arm 51 of each latching metallic piece 50 always receives a force from the cam section when the pressuring member 55 is at the closed position. When the connector is in use, the pressuring member is at the closed position, and the length of time when it is at the closed position is extremely long. Therefore, the upper arms receive a force for long period of time, and can be damaged by fatigue due to the inner stress.

The connecting section 53 of each latching metallic piece 50 is formed relatively thin and long so as to be flexibly displaced. When each latching metallic piece 50 latches on, stress is applied to the connecting section 53. If a force such as a force to forcibly remove FPC is further applied under such condition, the connecting section may be plastically deformed receiving even more stress.

SUMMARY OF THE INVENTION

In view of the above problems, an object of the invention is to provide a connector, in which each latching claw is surely latched onto the latching portion, such as the latching holes of a cable, and does not apply excess stress to the latching metallic pieces when the pressuring member is at the closed position.

The electrical connector for a flat-type cable according to the invention is comprised of an insulating housing, a plurality of terminals, which is arranged and held by the housing and is connected to a flat-type cable, latching metallic pieces, which are arranged in parallel with the plurality of terminals, pressuring members, which are freely rotatable between the open position for receiving the flat-type cable and the closed position for increasing the contact pressure to the terminals of the flat-type cable. Since each latching metallic piece has a latching claw that elastically displaces, it latches onto the latching sections of the cable, and therefore coming off of the flat-type cable from the connector is prevented.

In the electrical connector for a flat-type cable according to the invention, each latching metallic piece has a lever-like arm that extends in the direction of receiving the flat-type cable, and has a latching claw at one end of the lever-like arm, a fulcrum section at the middle point, and an extending section at the other end. The pressuring member has a restricting section that does not contact with the extending section when it is at the open position, but that prevents the displacement of the extending section when it is at the closed position. The pressuring member is in a condition that it can be freely displaced, so that the lever-like arm allows the flat-type cable inserted/removed to/from the connector when the pressuring member is at the open position. When it is at the closed position, the pressuring member does not allow the displacement of the lever-like arm in the direction that increases the latching of each latching claw onto the latching section, and prevents the displacement of the lever-like arm in the direction that reduces the latching when the pressuring member is at the closed position.

According to the connector of the above-described constitution according to this invention, the pressuring member does not contact with the lever-like arm when it is at the open position, and the lever-like arm is pressed by the front end of the flat-type cable when the cable is inserted to the connector, and freely displaces so as to allow the insertion of the flat-type cable. Once the flat-type cable is inserted to a specified position, each latching claw provided at one end of the lever-like arm latches onto the latching section of the flat-type cable, and maintains its latching condition, reducing the displacement of the lever-like arm. After that, the pressuring member is moved to the closed position and the flat-type cable is pressed to the contact section of each terminal. Once the pressuring member is moved to the closed position, the pressuring member prevents at the extending section, which is provided at the other end of the lever-like arm, the displacement of the lever-like arm in the direction that reducing the latching without applying a pressing force that increases the latching to the extending section. Accordingly, the lever-like arm does not generate any internal stress when each latching claw latches onto the latching section of the flat-type cable at a normal condition. Only when the cable is carelessly pulled in the cable-removal direction and the extending section becomes displaced receiving a force from the latching section at the latching claw, the lever-like arm receives temporary internal stress, which is a blocking force from the restricting section of the pressuring member.

In this invention, the restricting section of the pressuring member can be formed, for example, as a cam section that contacts with the extending section of each latching metallic piece and has the center of the rotation of the pressuring member.

In the invention, each latching metallic piece is formed, maintaining its original metal sheet surface, and has generally H-shape when it is viewed in the direction vertical to the metal sheet surface. Each latching metallic piece can be formed such that the upper arm works like a lever-like arm, the lower arm works as a securing section to the housing, and a section that connects the upper and lower arms and works like a fulcrum.

Furthermore, according to the invention, each latching metallic piece is mounted to the housing by inserting to corresponding slit of the housing from the side opposite the side for receiving the flat-type cable. In addition, each latching metallic piece has a stopper protrusion, which faces the corresponding portion of the housing at a specified inserting position, at least one of arms, i.e., the upper arm or the lower arm. In this case, if the cable receives unexpected force in the cable-removal direction, the stopper section of each latching metallic piece contacts with the corresponding section of the housing, which enables the displacement of the upper arm. Therefore, the connecting section that has relatively thin and long shape can be prevented from plastic deformation in the cable-removal direction, and provides resistance against the cable via the latching metallic pieces.

As described above, according to the invention, when the pressuring member is at the closed position, the restricting section of the pressuring member does not exert a force to the extending section of each latching metallic piece in the direction that increases the latching, and the displacement of the lever-like arm in the direction that reduces the latching of the latching claw is restricted at the lever section. Therefore, the latching can be surely maintained, and excess stress would not be applied to the latching metallic piece. In addition, the latching metallic piece would not be plastically deformed even when a force in the cable-removal direction is unexpectedly applied to the cable, and the latching metallic piece can maintain its functions over a long period of time.

BRIEF DESCRIPTION OF THE DRAWINGS

FIGS. 3(A) and 3(B) are cross-sectional views of a conventional connector; (A) is a view when the pressuring member is at open position; and (B) is a view when the pressuring member is at closed position.

PREFERRED EMBODIMENTS TO CARRY OUT THE INVENTION

Embodiments of the invention will now be described with reference to the accompanying drawings, FIGS. 1 and 2.

Figure 1:
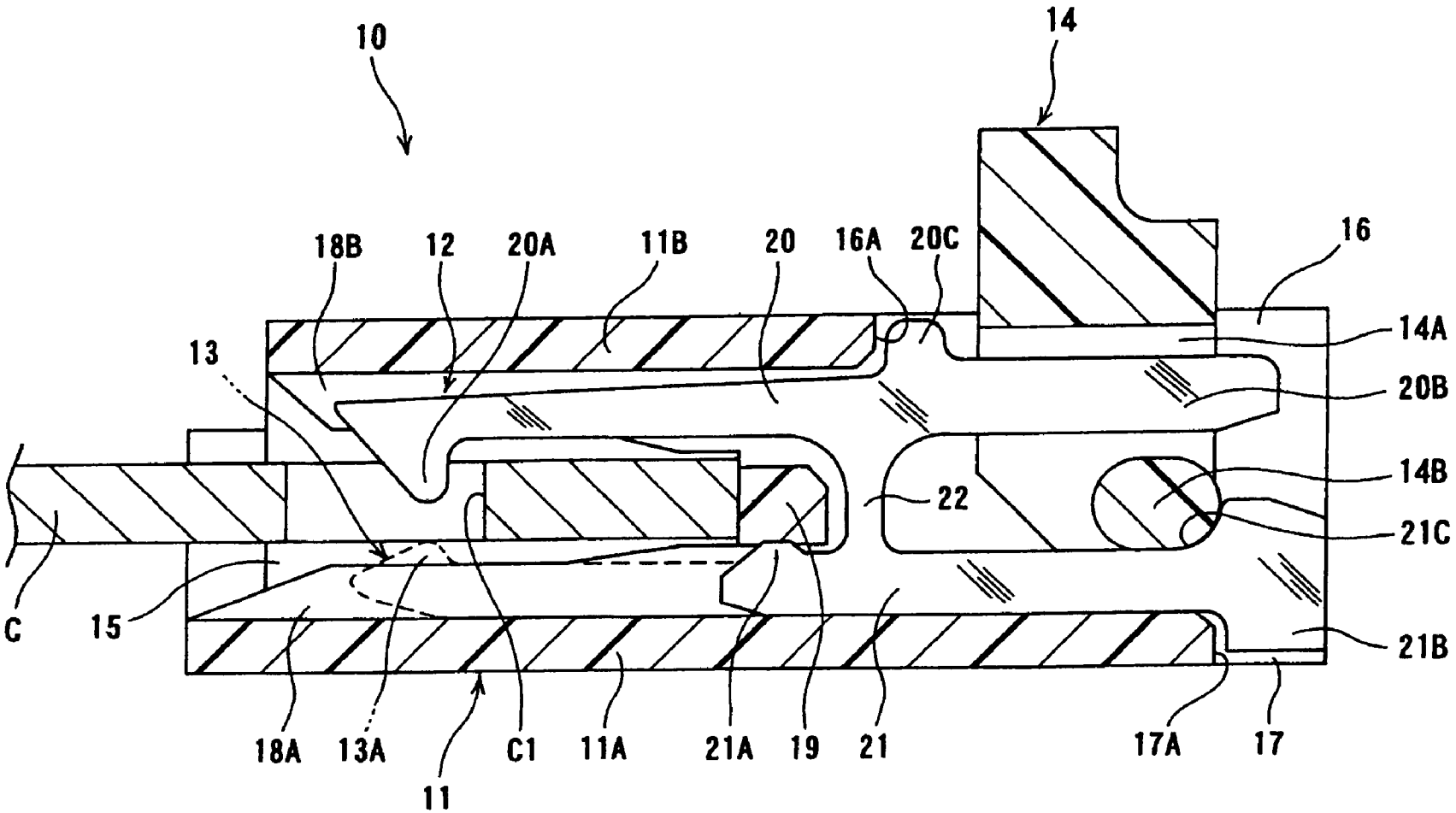
FIG. 1 is a cross-sectional view of a connector according to an embodiment of the invention when a pressuring member is at open position.

The electrical connector illustrated in FIG. 1 is mounted on a circuit board, and terminals are connected by soldering to a corresponding circuit unit of the circuit board at their connecting sections. On the other hand, the connector receives a flat-type cable from its opening, and the flat cable is connected with the above-described circuit unit via the terminals. Here, a flat-type cable includes so-called flat cable and flexible circuit board, etc.

In the connector 10 of FIG. 1, latching metallic pieces 12 and terminals 13 are held in an insulating housing 11 that has an outer shape of generally rectangular parallelpiped. A pressuring member 14 is supported by the latching metallic piece 12 and the terminal 13 so as to be freely rotatable. The housing 11 has a bottom wall 11A, which is arranged contacting with a circuit board by the surface, an upper wall 11B that is parallel to the bottom wall 11B and side walls (not illustrated) that faces each other in the vertical direction to the paper surface of the figure. The housing 11 has an outer shape of generally rectangular parallelpiped. The housing 11 has a thru hole 15 which is open in the left-and-right direction in the figure. In the thru hole 15, while a right edge of the upper wall 11B is cut out to form an upper opening, a right edge of the bottom wall 11A is cut out so as to form a lower opening 17. The edges of the upper wall 11B and the bottom wall 11A, which respectively face the upper opening 16 and the lower opening 17, form stopper sections 16A and 17A, respectively.

In the thru hole 15, the upper wall 11B and the bottom wall 11A have pectinated surface on the respective facing inner surfaces, when it is viewed from the left side in FIG. 1. Those uneven portions are open toward the inside of the housing and extend in the left and right direction of the figure. The uneven portions have groove sections 18A and 18B, and a pair of the grooves 18A and 18B, which face each other in the vertical direction work as a supporting groove to support each terminal.

The housing has securing sections 19, which are formed between but away from the respective two facing grooves 18A and 18B in the vertical direction and look like islands when they are viewed from the left side of the figure. The terminals are secured by pressing a part of each terminal in between the securing section 19 and the bottom wall 11A.

Each latching metallic piece 12 and each terminal 13 are formed, maintaining its original sheet metal surface, and have an upper arm and a lower arm, which are connected at the middle portion so as to have an H-shape. Each latching metallic piece 12 and each terminal 13 have similar shapes with regards to the upper arm and the connecting section, but have slightly different shapes at the lower arm.

In FIG. 1, the terminals 13 are arranged and held in a plurality of grooves 18A and 18B at certain intervals in the direction perpendicular to the paper surface of the figure. Each latching metallic piece is held by the above-described grooves 18A and 18B at the both ends of the arrangement.

Each latching metallic piece 12 has a lever-like arm 20 that extends in the left and right direction of the figure as an upper arm, a securing section 21 that extends in the left and right direction of the figure as a lower arm, and a connecting section 22 to connect the lever-like arm 20 and the securing section 21. At the lever-like arm 20, its left part extends almost up to the left edge of the housing and has at its left end a latching claw 20A that protrudes downward. On the other hand, the right part of each lever-like arm 20 extends almost up to the right edge of the housing and has an extending section 20B on which a straight lower edge is formed. Furthermore, each lever-like arm 20 has at the upper edge a stopper protrusion 20C that faces the stopper section of the housing. Each lever-like arm 20 can be elastically displaced like a lever, while the connecting section 22 works as the fulcrum. For this purpose, each connecting section 22 is formed thin or has a pinched shape so as to enable such displacement.

Each securing section 21, which is the lower arm, extends slightly leftward from the connecting section 22 and has a protrusion 21A at its left end. Simultaneously, the securing section 21 extends rightward from the connecting section 22 up to the right end of the housing and has a stopper protrusion 21B that protrudes toward the lower opening 17 and faces the stopper section of the housing. In addition, each securing section 21 has a curved cam guiding section 21C at the upper edge of the right end side.

Each terminal 13 has an upper arm that has similar shape to that of the latching metallic piece 12, i.e., the lever-like arm, and a connecting section. In FIG. 1, however, since terminals are arranged behind the latching metallic piece, they are not illustrated. The lower arm of each terminal extends from the connecting section almost up to the left end of the housing, and has a protruding contact section 13A at the upper edge of the left end. In addition, the lower arm of each terminal 13 has similar shape to that of the latching metallic pieces at the right part from the connecting section, but has a connecting section that protrudes slightly lower than the bottom surface of the bottom wall 11A of the housing at the portion that corresponds to the stopper protrusion 21A of the latching metallic pieces. The connecting section is designed to connect by soldering to a corresponding circuit unit on the circuit board.

The above-described latching metallic pieces 12 and terminals 13 are inserted to the housing from the right side. The left portion of each lever-like arm 20, i.e. upper arm, and the left portion of the securing section, i.e., lower arm, are guided by the pectinated grooves 18B and 18A. For the latching metallic pieces 12, the protrusion 21A of each securing section 21 is pressed between the bottom wall 11A of the housing and the securing section 19. At this time, each latching metallic piece 12 can be positioned by contacting its stopper protrusion 21B with the stopper section 17A.

Each pressuring member 14 is made of an insulating material, and formed so as to work like a lever. Each pressuring member is arranged in the right portion of the thru hole 15 of the housing as illustrated in FIG. 1, and supported by the latching metallic piece 12 and the terminal 13 so as to be freely rotatable. Each pressuring member 14 has a slit groove 14A, which is the lower portion of the pressuring member and is opened downward, leftward and rightward as shown in FIG. 1. Each slit groove 14 is formed corresponding to the latching metallic piece 12 and the terminal 13, and receives the extending sections of the latching metallic piece 12 and the terminal 13, which are the right portions of the respective lever-like arms. Moreover, each slit groove 14A has an oval cam section 14B at the lower edge of the pressuring member 14 as a restricting section, and connects the inner surfaces of the slit grooves 14A that faces each other. Each cam section 14B is arranged between the lower edge of the extending section 20B and the curved cam guiding section 21C that is formed at the upper edge of the securing section 20. The cam section 14B has an oval surface. The short diameter (i.e., height dimension in FIG. 1) of each cam section 14B is set so as to have space between the cam section and the lower edge of the extending section 20B when the pressuring member is at the open position as illustrated in FIG. 1, and the long diameter is set so as to have no such space when the pressuring member 14 is rotated to the closed position as illustrated in FIG. 2. Such cam section 14B, as will be described later, restricts the downward displacement of the extending section 20B of the latching metallic piece 12, and makes smooth the rotation of the pressuring member 14 being guided by the cam guiding section 21C. Here, the position of the pressuring member 14 is referred to as "open position" when the pressuring member 14 is at the position illustrated in FIG. 1, while the position of the pressuring member 14 is referred to as "closed position" when the pressuring position is at the position illustrated in FIG. 2.

The flat-type cable C which connects to the connector 10 has a portion (not illustrated) at least on its upper or lower surface to make electrical connection to terminals 13, and has latching sections C1, each of which has a hole-like shape or notched shape at a position that corresponds to the latching metallic piece 12, at the both edges of the flat-type cable in the width direction (in the direction vertical to the paper surface of FIG. 1). The latching claw 20A of the lever-like arm 20 of each latching metallic piece, which is in free condition, is put in the latching section C1 of the flat-type cable C. Since the flat-type cable does not have another holes like the latching sections C1 between the two latching sections C1 in the width direction, the front end protrusion of each terminal that has similar shape to that of the latching claw presses the flat-type cable C downward.

In the connector according to this embodiment of this constitution, the flat-type cable is connected as described below, and latched by the latching metallic pieces.

First, before inserting the flat-type cable to the connector, the pressuring member 14 is moved to the open position as shown in FIG. 1. At this open position, in each pressuring member 14, the cam section 14B is arranged so as to be horizontally long, there is space between the cam section 14B and the extending section 20B of the latching metallic piece 12 (and the extending section of the terminal 13). The cam section 14B does not contact with the lever-like arm 20, and the latching claw 20A of the lever-like arm 20 is in condition that it can be displaced by external force.

In this condition, the flat-type cable C is inserted to the housing 11 from the left side. The front end of the flat-type cable C contacts with the latching claw 20A of each latching metallic piece 12, and apply upward force thereto, and the flat-type cable C itself enters further inward and then stopped once the front end contacts with the securing section 19. Once the flat-type cable moves in, each hole-like latching section C1 of the flat-type cable C reach the latching claw 20A, and each latching claw 20A is latched in the latching section C1. Therefore, the lever-like arm 20 of each latching metallic piece 12 is released from the stress from being lifted by the flat-type cable C, and becomes free. On the other hand, the flat-type cable C does not have a hole-like section at a portion that corresponds to each terminal 13, but the front protrusion of the lever-like arm that corresponds to the latching claw 20A does not protrude downward like the latching claws. Therefore, when FPC (flexible printed circuit) is inserted in the housing, since the front protrusion does not protrude so much, it would not contact or would slightly contact with the FPC.

On the other hand, each cam section that corresponds to the terminal is formed slightly longer than the cam section formed at a position corresponding to each latching metallic piece. Under this condition, the extending section of each terminal 12 is pushed upward, but the portion of each terminal, which corresponds to the latching claw, presses the FPC from the upper surface being pushed downward.

Figure 2:
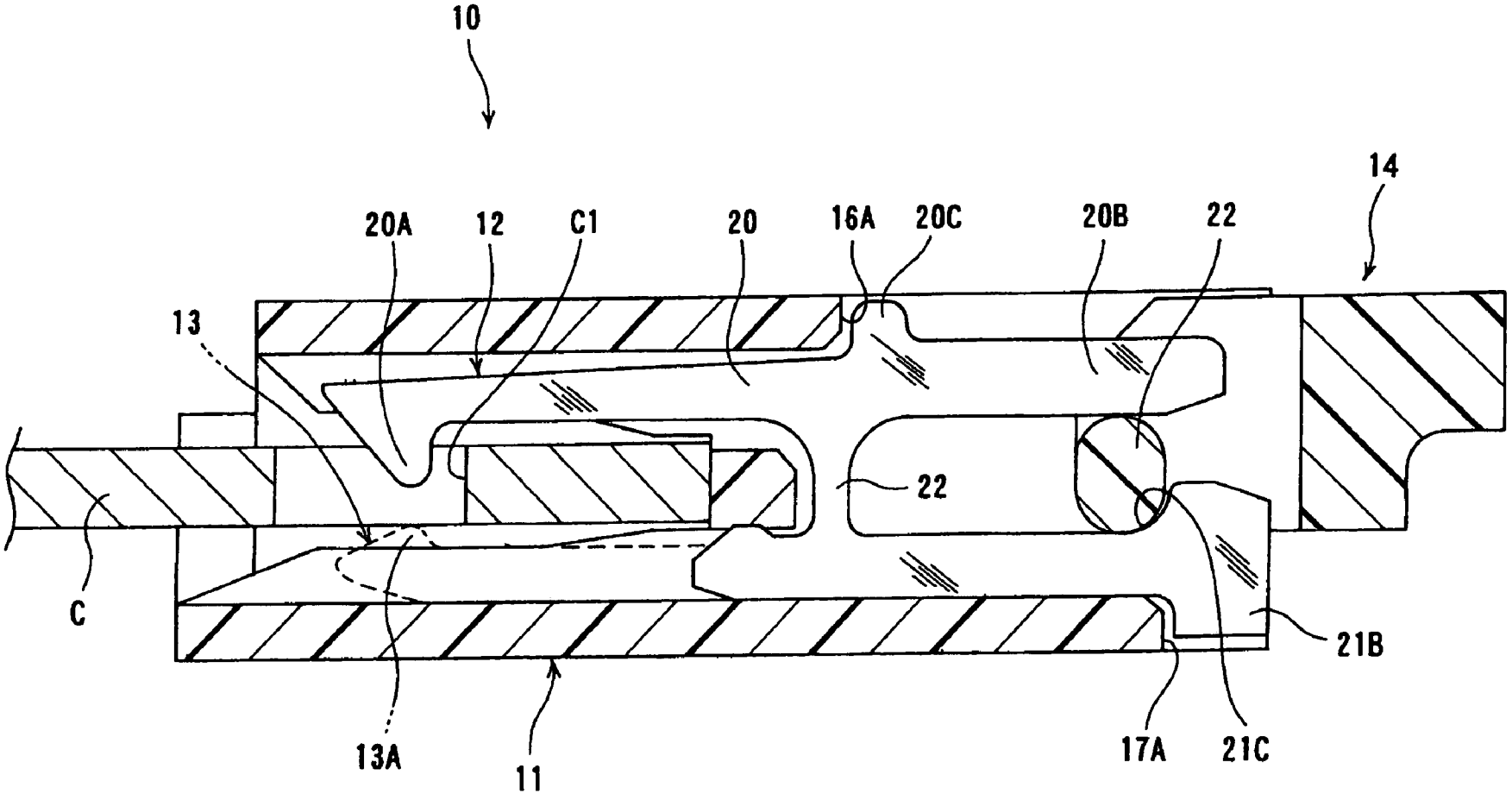
FIG. 2 is a cross-sectional view of FIG. 1 when the pressuring member is at closed position.

Next, the pressuring member 14 is rotated to the closed position as shown in FIG. 2. At the closed position, the cam section 14B of each pressuring member 14 is vertically long, and slightly contacts with the extending section 20B of the lever-like arm 20 or forms very small space. Therefore, downward displacement of the extending section 20B, i.e., upward displacement of the latching claw 20A of the lever-like arm 20 is prevented. As a result, without applying any force to the lever-like arm in the direction that increase the latching of the latching claw 20A, when the flat-type cable C is pulled leftward carelessly, the latching of the latching claw will not reduced and maintained, and coming off of the flat-type cable C can be surely prevented. In addition, in this embodiment, even if each latching metallic piece 12 is pulled leftward by the cable, the stopper protrusion 20C of the latching metallic piece 12 contacts with the stopper section 16A of the housing 11; therefore, plastic deformation of the connecting section in the inserting/removal direction, which has relatively thin and long shape for elastic displacement, can be prevented, and the reaction against the cable can be increased.

In this invention, each terminal has a contact section 13A at the lower arm, and the contact section is electrically connected with the contacting section formed on the lower surface of the flat-type cable. If the flat-type cable has the connecting section on the upper surface, the protrusion of the upper arm (a section that corresponds to the latching claw 20A of the latching metallic piece) can work as the contact section. Of course, connection can be also made on the both surfaces.

The invention claimed is:

1. An electrical connector for a flat-type cable, comprising:

an insulating housing;

a plurality of terminals that is arranged and held in said housing, and is connected to said flat-type cable;

a latching metallic piece that is arranged in parallel with said plurality of terminals, which is comprised of:

a lever-like arm that extends in a direction of receiving said flat-type cable, said lever-like arm having a latching claw at one end, a fulcrum section at a middle part, and an extending section at the other end, wherein said latching claw prevents coming off of said flat-type cable from said housing, and latches onto a latching section of said flat-type cable by its elastic displacement and prevents coming off of said flat-type cable from said housing; and a pressuring member that can be freely rotated between an open position that enables reception of said flat-type cable to said housing and a closed position that increases the contact pressure of terminals to said flat-type cable, and that has a restricting section that does not contact with said extending section of said latching metallic piece at said open position, and prevents displacement of said extending section at said closed position, wherein said lever-like arm is in a state that it can be freely displaced so as to allow insertion/removal of said flat-type cable to/from said housing when said pressuring member is at said open position, and said lever-like arm does not displace in the direction that increases the latching of said latching claw onto said latching section and is prevented from displacement in the direction that reduces said latching.

2. The electrical connector for a flat-type cable according to claim 1, wherein said restricting section of said pressuring member is formed as a cam section that contacts with said extending section of said latching metallic piece, and said cam section has the center of the rotation of said pressuring member.

3. The electrical connector according to claim 1, wherein said latching metallic piece is formed maintaining its original metal sheet surface, and has generally H-shape when it is viewed from the direction vertical to said surface, and said upper arm, said lower arm, and a portion that joints between said upper arm and said lower arm respectively form a lever-like arm, a securing section to said housing, and fulcrum section.

4. The electrical connector for a flat-type cable according to claim 1, wherein said latching metallic piece is inserted and mounted to corresponding slit from the side opposite to the side for receiving said flat-type cable, has a stopper protrusion that faces corresponding section of said housing at a specified inserting position at least one of arms.

* * * * *